US009599431B2

(12) United States Patent
Griffin

(10) Patent No.: US 9,599,431 B2
(45) Date of Patent: Mar. 21, 2017

(54) DEVICE FOR ATTACHMENT TO A PROFILED RAIL

(75) Inventor: Todd Griffin, Miami, FL (US)

(73) Assignee: RM Equipment, Inc., Miami, FL (US)

( * ) Notice: Subject to any disclaimer, the term of this patent is extended or adjusted under 35 U.S.C. 154(b) by 419 days.

(21) Appl. No.: 13/979,992

(22) PCT Filed: Jan. 17, 2012

(86) PCT No.: PCT/US2012/021543

§ 371 (c)(1),
(2), (4) Date: Feb. 25, 2014

(87) PCT Pub. No.: WO2012/099876

PCT Pub. Date: Jul. 26, 2012

(65) Prior Publication Data

US 2014/0190061 A1 Jul. 10, 2014

Related U.S. Application Data

(60) Provisional application No. 61/553,426, filed on Oct. 31, 2011, provisional application No. 61/552,061, (Continued)

(51) Int. Cl.

| | |
|---|---|
| ***F41C 27/06*** | (2006.01) |
| ***F41C 27/00*** | (2006.01) |
| ***F41G 11/00*** | (2006.01) |

(52) U.S. Cl.

CPC ..... *F41C 27/06* (2013.01); *F41C 27/00* (2013.01); *F41G 11/003* (2013.01)

(58) Field of Classification Search

CPC ..... F41C 27/00; F41C 27/06; F41G 11/003
(Continued)

(56) References Cited

U.S. PATENT DOCUMENTS 4,689,911 A * 9/1987 White ..... F41A 19/39 42/1.06
4,733,489 A 3/1988 Kurak
(Continued)

OTHER PUBLICATIONS

Young, Lee W., PCT International Search Report and Written Opinion of the International Searching Authority, PCT Application No. PCT/US12/21543, May 10, 2012.
(Continued)

*Primary Examiner* — Michelle R Clement

(57) ABSTRACT

A device for selective affixation to a profiled rail is generally provided. The device generally includes a body and a clamp assembly operatively supported thereby. The body has an upper portion characterized by first and second opposing and spaced apart sidewall segments. The first sidewall segment has a profiled rail receiving surface and the second sidewall segment has a channeled face. The clamp assembly includes a clamping block adapted for advancement toward the profiled rail receiving surface of the first sidewall segment of the upper body portion, a portion of the clamping block pivotingly received by the channeled face of the second sidewall segment of the upper body portion so as to operatively self-seat the clamping block with a profiled rail interposed between the first sidewall segment and the clamping block of the clamp assembly upon advancement thereof.

19 Claims, 10 Drawing Sheets

Related U.S. Application Data filed on Oct. 27, 2011, provisional application No. 61/433,429, filed on Jan. 17, 2011.

(58) Field of Classification Search
USPC ..... 42/105
See application file for complete search history.

(56) References Cited

U.S. PATENT DOCUMENTS 5,142,806 A 9/1992 Swan
5,276,988 A * 1/1994 Swan ..... F41G 11/003 42/127
5,680,725 A * 10/1997 Bell ..... F41G 11/003 42/127
5,737,866 A * 4/1998 Minaire ..... F41C 27/06 42/105
5,826,363 A 10/1998 Olson
5,930,935 A 8/1999 Griffin
5,941,489 A 8/1999 Fanelli et al.
6,134,823 A 10/2000 Griffin
6,438,888 B1 * 8/2002 Lin ..... F41G 1/34 362/110
6,453,594 B1 9/2002 Griffin
6,490,822 B1 12/2002 Swan
6,606,813 B1 8/2003 Squire et al.
6,792,711 B2 9/2004 Battaglia
6,922,934 B1 * 8/2005 Huan ..... F41G 11/003 42/127
7,308,772 B1 * 12/2007 Millett ..... F41G 11/004 42/124
7,493,721 B2 2/2009 Swan
7,562,485 B2 * 7/2009 Newhall ..... F41G 11/003 42/124
7,591,098 B2 * 9/2009 Matthews ..... F41G 11/003 362/110
7,698,847 B2 4/2010 Griffin
7,735,255 B1 * 6/2010 Kincaid ..... F41G 1/35 362/110
7,739,824 B1 6/2010 Swan
7,823,316 B2 * 11/2010 Storch ..... F41C 27/00 42/127
7,886,476 B1 * 2/2011 Swan ..... F41C 27/00 403/374.5
7,891,130 B2 * 2/2011 Griffin ..... F41C 27/06 42/105
8,128,047 B1 * 3/2012 Larue ..... F41G 11/003 248/316.1
8,132,355 B1 * 3/2012 Kincaid ..... F41C 33/0254 362/110
8,322,066 B2 * 12/2012 Westra ..... F41G 11/004 42/146
8,336,246 B1 * 12/2012 Barber ..... 42/124
8,438,965 B2 * 5/2013 Collin ..... F41G 11/003 89/125
8,453,369 B1 * 6/2013 Kincaid ..... F41G 1/35 403/322.1
8,499,484 B2 * 8/2013 Schneider ..... F41G 1/387 340/505
8,806,796 B1 * 8/2014 Clifton ..... F41G 11/003 42/127
8,813,412 B2 * 8/2014 Rorick ..... F41G 11/003 248/689
8,857,097 B2 * 10/2014 Rorick ..... F41G 11/003 42/114
8,893,424 B2 * 11/2014 Haering ..... F41G 11/003 42/126
8,898,949 B1 * 12/2014 Greenwood ..... F41G 1/387 42/124
8,959,825 B2 * 2/2015 Goertzen ..... F41G 11/001 42/124
8,973,296 B1 * 3/2015 Kocmich, IV ..... F41G 11/003 42/90
2005/0241211 A1 11/2005 Swan
2006/0201044 A1 * 9/2006 Griffin ..... F41C 27/06 42/105
2006/0277809 A1 * 12/2006 Moody ..... F41A 23/08 42/72
2008/0134559 A1 * 6/2008 Swan ..... F41G 11/003 42/90
2010/0107467 A1 5/2010 Samson et al.
2012/0151813 A1 * 6/2012 Brown ..... F41C 7/00 42/73
2013/0312309 A1 * 11/2013 Rorick ..... F41C 27/00 42/114
2014/0116238 A1 * 5/2014 Hagedorn ..... F41A 27/30 89/37.03
2014/0190062 A1 * 7/2014 Turner, Jr. ..... F41G 1/387 42/124
2014/0331541 A1 * 11/2014 Rorick ..... F41G 11/003 42/90

OTHER PUBLICATIONS

Clement, Michelle, PCT International Preliminary Report on Patentability, PCT Application No. PCT/US12/21543, Apr. 5, 2013.

* cited by examiner

DEVICE FOR ATTACHMENT TO A PROFILED RAIL

This is an international application filed under 35 USC §363 claiming priority under 35 USC §120 of/to U.S. Pat. Appl. Ser. Nos. 61/433,429, 61/552,061, and 61/553,426 having filing dates of Jan. 17, Oct. 27, and Oct. 31, 2011 and respectively entitled SUPPLEMENTAL DEVICE RECEIVER, UNIVERSAL RECEIVER, and INTERFACE ARTICLE FOR INTEGRATING A SUPPLEMENTAL DEVICE TO A HOST WEAPON, the disclosures of each hereby incorporated by reference in their entireties.

TECHNICAL FIELD

The present disclosure generally relates to firearms or replicas thereof, operative or otherwise, more particularly, to a device or fixture to facilitate operative union of an accessory article or a supplemental device to a firearm or a replica thereof, operative or otherwise, more particularly still, to a device or fixture receivable upon and securable to a profiled rail of a rail structure of a firearm or a replica thereof, operative or otherwise.

BACKGROUND OF THE INVENTION

Weapon adaptability has been and remains advantageous. Generalists have sought to add functionality to their weapon. A well known, and well documented example of enhanced functionality, namely, dual functionality, is the M203 40 mm grenade launcher. This single shot launcher was designed as a rifle attachment in order to increase the efficiency with which a soldier could alternate between bullet fire via the "host weapon," and high energy grenade fire which was previously available via use of a dedicated, separate weapon, namely, the M79. Many interface approaches were developed in furtherance of equipping a host weapon with the M203 launcher (e.g., U.S. Pat. No. 4,733,489 (Kurak), U.S. Pat. No. 5,930,935 (Griffin), and U.S. Pat. No. 6,134,823 (Griffin)).

In addition to a primary function of propelling a munition, a variety of supplemental or secondary weapon system functions/features are advantageous and well know. For example, accessory articles for enhanced target sighting, target illumination, and weapon support (via shoulder strap, grip, bi-pod, tri-pod, etc.), to name but a few, are well known. To facilitate such enhanced functionality for a weapon/host weapon (i.e., the inclusion of accessory articles), interface solutions were sought, and a rail system (i.e., bracket) emerged.

The two most common are the Rail Interface System (RIS) and Rail Adapter System (RAS), each of which is essentially a bracket, more particularly an accessory mounting rail, used in connection to small arms weapons. The rails commonly replace the factory handguards of a host weapon system, e.g., SR-15(AR-15), M-16, or SR-25 weapon systems (see e.g., U.S. Pat. No. 6,490,822 (Swan) and U.S. Pat. No. 5,826,363 (Olsen)) or other element thereof such as a handle (see e.g., U.S. Pat. No. 5,142,806 (Swan)), and are placed directly on the receiver of the weapon. Alternately, unaltered or minimally altered host weapon rail arrangements are know, more particularly, those in which rails are added to the host weapon as opposed to substituted for a portion of the barrel handguard or the like (see e.g., U.S. Pat. No. 6,792,711 (Battaglia)). Either rail style/format functions so as to provide attachment points for a variety of weapon system accessories such as tactical lights and laser sighting modules.

The subject systems have their origins in military standard "MIL-STD-1913 (AR), 3 Feb. 1995" entitled "Dimensioning of Accessory Mounting Rail for Small Arms Weapon", and an update thereto, namely, "MIL-STD-1913 Update Notice 1, 10 Jun. 1999." The subject standard, herein incorporated by reference, established methods of dimensioning accessory mounting rails for small arms weapon systems, and also established uniform accessory mounting rails and requirements that are interchangeable among the different units of the United States Department of Defense. As the standard was first published by the Picatinny Arsenal of N.J. , such devices are commonly referred to as "Picatinny rails." The standard, having been adopted by the North Atlantic Treaty Organization (NATO), is also know by that organization's designation, namely, STANAG 2324.

As previously noted, known rail systems are generally, but not necessarily installed in place of the weapon hand guard (i.e., substituted therefore), and are intended to provide a universal structure (i.e., a profiled rail) for mating attachment (i.e., receipt) of accessories, e.g., a flashlight, a thermal scope, a laser, etc., to the rifle at 3, 6, 9, and 12-o'clock positions about the weapon barrel. Known systems incorporate different rail lengths and integration techniques for attachment of the rail structure to the weapon. Some units consist of a two-piece assembly, namely, a first portion providing rails at the 3, 9, and 12-o'clock positions, and a second portion providing a rail at/for the 6-o'clock position. Heretofore, it had been advantageous that the rail of the 6-o'clock position be separately removable so as to permit grenade launcher installation (i.e., in lieu thereof, as each structure competes for the same physical space, and generally uses the same attachment points on the weapon).

Numerous interface arrangement solutions for attaching to a profiled rail of a rail structure are known. For example, in the context of the ever prevalent vertical forend grips, such devices themselves are characterized by the well known female mounting flange which is slidingly received upon a profiled rail of the RAS, and thereafter selectively bound against a portion of the profiled rail via, for example, a threaded fastener tightened to engage or press against the profiled rail so as to secure the grip thereto (see e.g., U.S. Pat. Appl. Pub. No. US 2006/0277809A1 (Moody et al.) and U.S. Pat. No. 5,941,489 (Fanelli et al.)). Moreover, actuatable jaws or jaws segments, configured for receipt of a segment of a profiled rail, are known for operative engagement with a profiled rail of the RAS, see e.g., the RailGrip™ vertical forend device of RM Equipment, Inc., Miami Fla. (RME), note also U.S. Pat. No. 7,698,847 (Griffin). Further still, a variety of fixtures, generally securable to a profiled rail of the RAS and adapted to receive/support a supplemental device once secured to the rail structure, are well known, see e.g., the lever actuated camming style fixtures of U.S. Pat. No. 7,739,824 (Swan), U.S. Pat. No. 7,493,721 (Swan) & U.S. Pat. No. 5,276,988 (Swan).

While fastening ease and reliability of the fastened condition or state for and between the supplemental device and the profiled rail of the RAS are no doubt important considerations, a one-size-fits-most approach has its shortcomings as the characterization implies. Such shortcomings are particularly noteworthy in the context of supporting a supplemental device as opposed to a relatively passive device such as accessory articles, e.g., a light, a sight, a grip, etc. For instance, in the context of equipping a host weapon with a grenade launcher, the physics associated with the launcher, i.e., its form and functionality in furtherance of firing a round that will be appropriately armed, and attendant forces generated during operation, necessitate foregoing a one-size-fits-most clamping solution. Moreover, tolerance departures as to the technical specifications of/for a given profiled rail of a rail structure are often encountered, with a one-size-fits-most approach further hamstrung in this regard.

In light of the foregoing, it is believed particularly advantageous to provide a robust and versatile rail attachment solution for a weapon or replica thereof, operative or otherwise, either as a primary or as a supplemental article or device, in the form of a device or fixture which is characterized by a body and a clamp assembly, operatively supported thereby, for sure reliable selective attachment to a profiled rail of a rail structure. Moreover, such apparatus or fixture should not encumber or otherwise negatively impact functionality and/or operator ergonomics in relation to use of the host and/or the supplement, and advantageously, a profiled rail attachment solution is contemplated which may be contextually specific (i.e., in the form of an adapted supplemental device such as a grenade launcher, or an adapted accessory article such as a forend grip wherein a device or fixture body is part-and-parcel of the supplement/accessory), or contextually generic (i.e., the fixture body is adapted or readily adaptable to operably receive, engage, etc. a supplement/accessory, a portion thereof or one or more elements thereof). Further still, it is believed both desirable and advantageous to provide such device, article, apparatus or fixture having means for selective affixation to the profiled rail which is sure and reliable, more particularly, to provide a clamping assembly wherein actuatable clamping elements possess heretofore unseen degrees of freedom in furtherance of accommodating and reliably securing rails having profiles within a select range of dimensional tolerances, and more particularly still, to provide actuatable clamping elements which self-seat in relation to an apparatus body and a profiled rail so received.

SUMMARY OF THE INVENTION

A device for selective affixation to a profiled rail is generally provided. The device generally includes a body and a clamp assembly operatively supported thereby. The body has an upper portion characterized by first and second opposing and spaced apart sidewall segments. The first sidewall segment has a profiled rail receiving surface and the second sidewall segment has a channeled face. The clamp assembly includes a clamping block adapted for advancement toward the profiled rail receiving surface of the first sidewall segment of the upper body portion, a portion of the clamping block pivotingly received by the channeled face of the second sidewall segment of the upper body portion so as to operatively self-seat the clamping block with a profiled rail interposed between the first sidewall segment and the clamping block of the clamp assembly upon advancement thereof.

Advantageously, the clamp assembly is hosted or otherwise operatively supported with a body, a platform, a base, etc., which may take a variety of forms. For instance, and without limitation, the clamp assembly and operable companion portions within which a profiled rail of a rail structures is clampingly engaged, may be a receiver of a weapon or replica weapon, e.g., a grenade launcher receiver, an interbar or other structure with which a supplemental device such as a grenade launcher is readily attached to or otherwise integrated with the interbar of the interbar/launcher combination in turn clampingly engages a profiled rail of a rail structure of a host weapon or the like.

In keeping with the entirety of the subject disclosure and cited priority documents, improved supplemental device receivers, a universal receiver and an interface article for integrating a supplemental device to a host weapon, among other things, are likewise contemplated. More particularly, such devices characterized by an especially advantageous, sure, reliable profiled rail attachment solution for supplemental devices and/or accessory articles which heretofore have not been well suited to profiled rail attachment or configured for quick, easy, robust and reliable attachment. Finally, a self-seating clamping block to enable variable toleranced rail profile attachment is contemplated, with provisions made for same.

BRIEF DESCRIPTION OF THE DRAWINGS

The apparatus, assemblies, subassemblies, structures and/or elements disclosed directly or implicitly herein may be embodied in other specific forms without departing from the spirit or general characteristics thereof, some of which forms have been indicated, thus, the features described and depicted herein/herewith are to be considered in all respects illustrative and not restrictive with the following brief description of the drawings and their content.

DETAILED DESCRIPTION OF THE INVENTION

Figure 10:
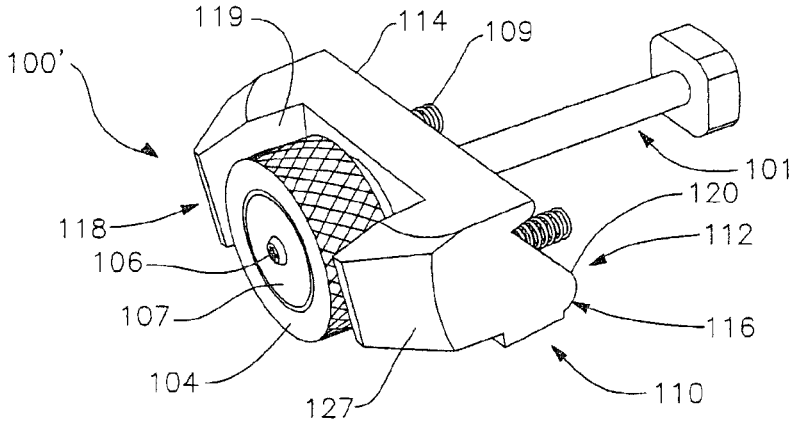
FIG. 10 depicts the clamp assembly of FIG. 9.
Figure 11:
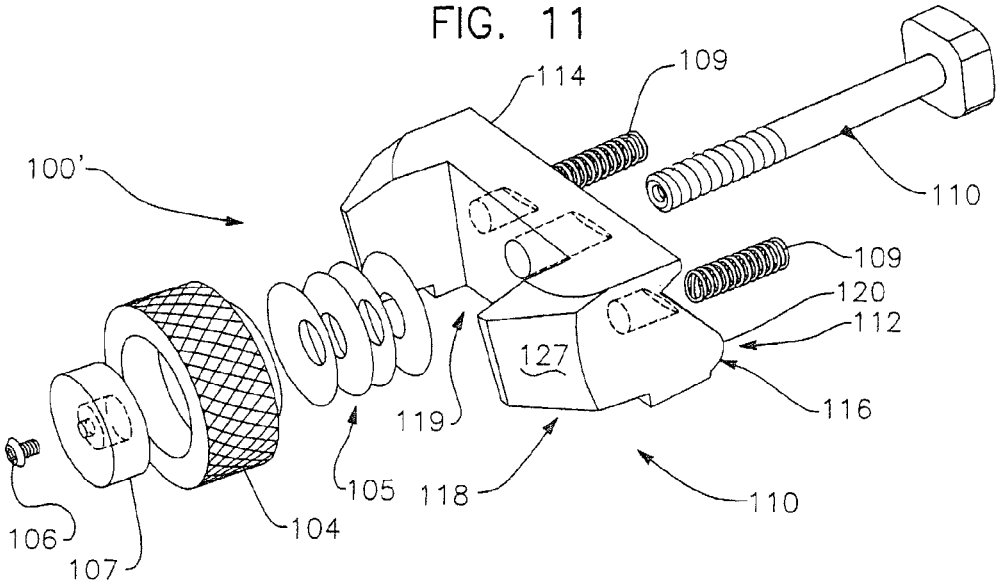
FIG. 11 depicts, exploded view, the clamp assembly of FIG. 10.

Preferred, non-limiting apparatus, devices, assemblies, mechanisms, structures, etc. are presented throughout the figures of the subject disclosure and generally described herein. A device, in the form of a fixture or the like, is generally provide, more particularly, a device for selective affixation to a profiled rail of a rail structure characterized by a body, e.g., and without limitation, a weapon receiver (i.e., as per either of FIG. 1 or 9) or an interbar (i.e., as FIG. 12 and FIGS. 13 & 14) and a clamp assembly, e.g., as FIGS. 4-8 and/or FIG. 10, operatively supported thereby. Intended receipt of a rail structure by the body of the device is readily appreciated with reference to FIG. 2, with clamping assembly mechanics and relationships for, between, and among structures of the body, the clamping assembly and the profiled rail of the rail structure set forth in connection to the depictions of each of FIGS. 4-8. Finally, particulars of a preferred, non-limiting clamp assembly per se are depicted in FIGS. 10 & 11, more particularly, particulars of the clamp assembly of the devices of either of FIG. 9 or FIG. 12.

Figure 1:
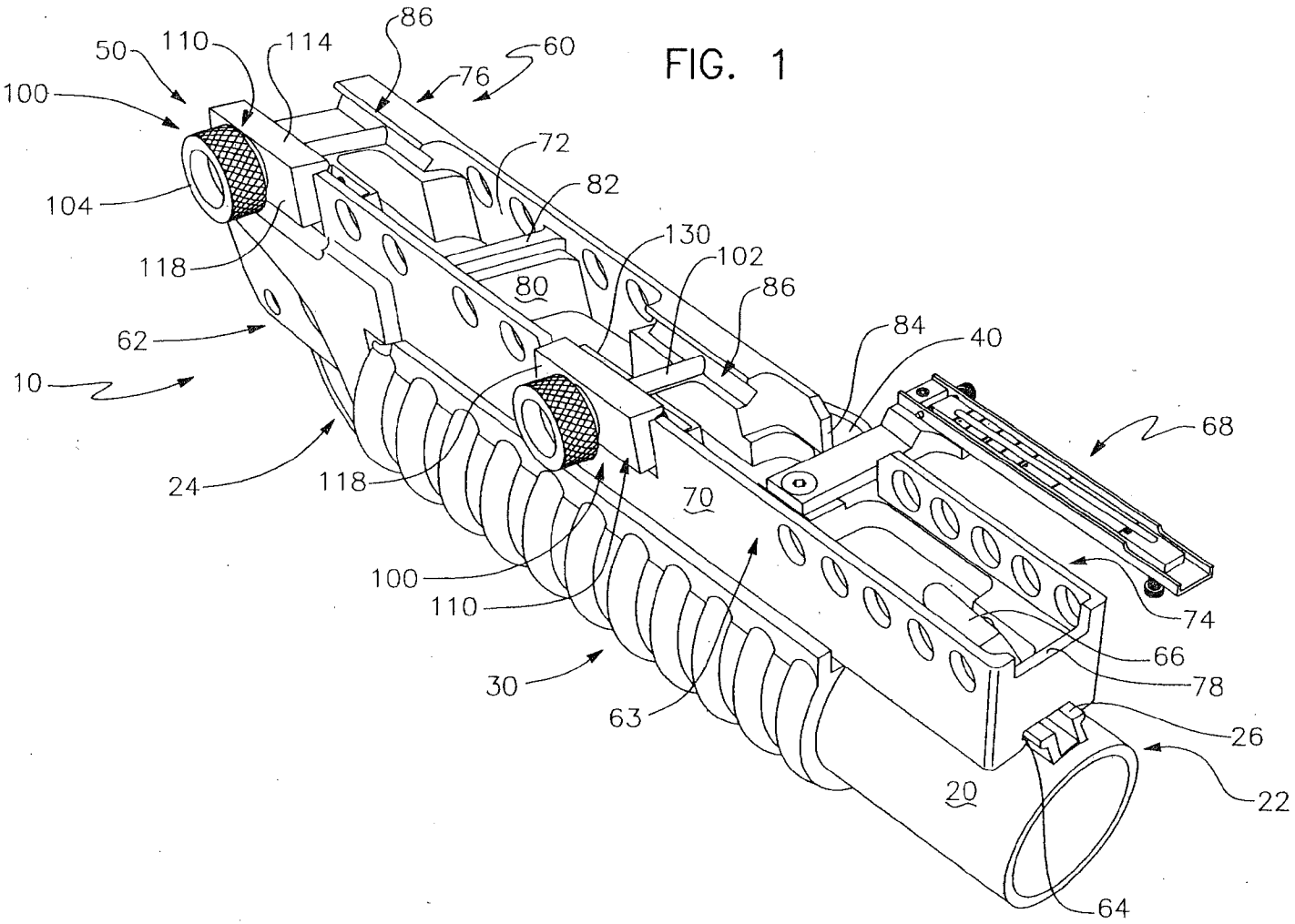
FIG. 1 depicts, slightly from above and viewed front (right) to (left) rear, a grenade launcher characterized by a profiled rail attachment structure, more particularly, an adapted upper launcher receiver portion and a clamp assembly operatively supported thereby.
Figure 2:
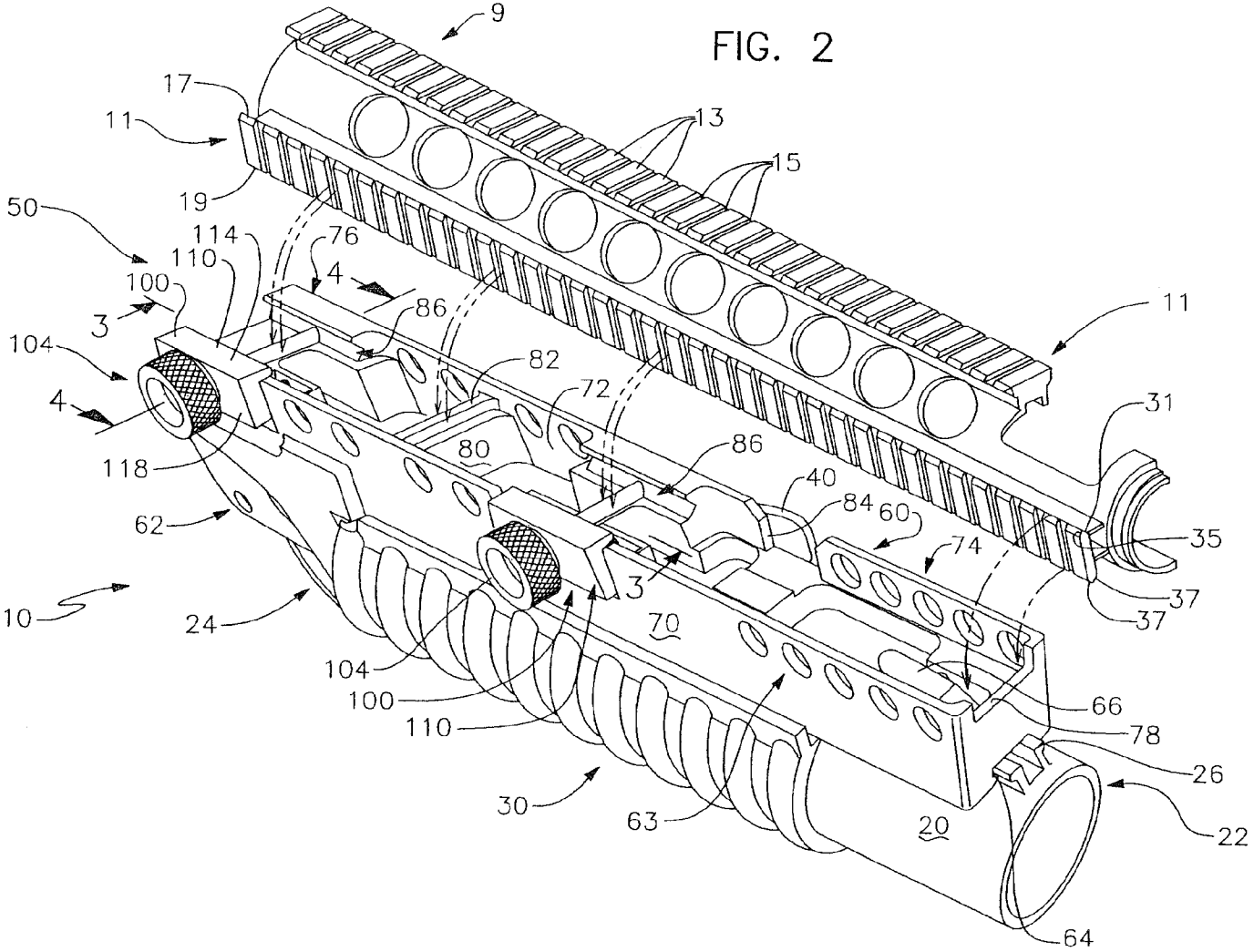
FIG. 2 depicts the FIG. 1 grenade launcher and an exemplary rail structure thereover, a profiled rail of the rail structure intended for receipt upon an upper portion of the launcher receiver as indicated.
Figure 9:
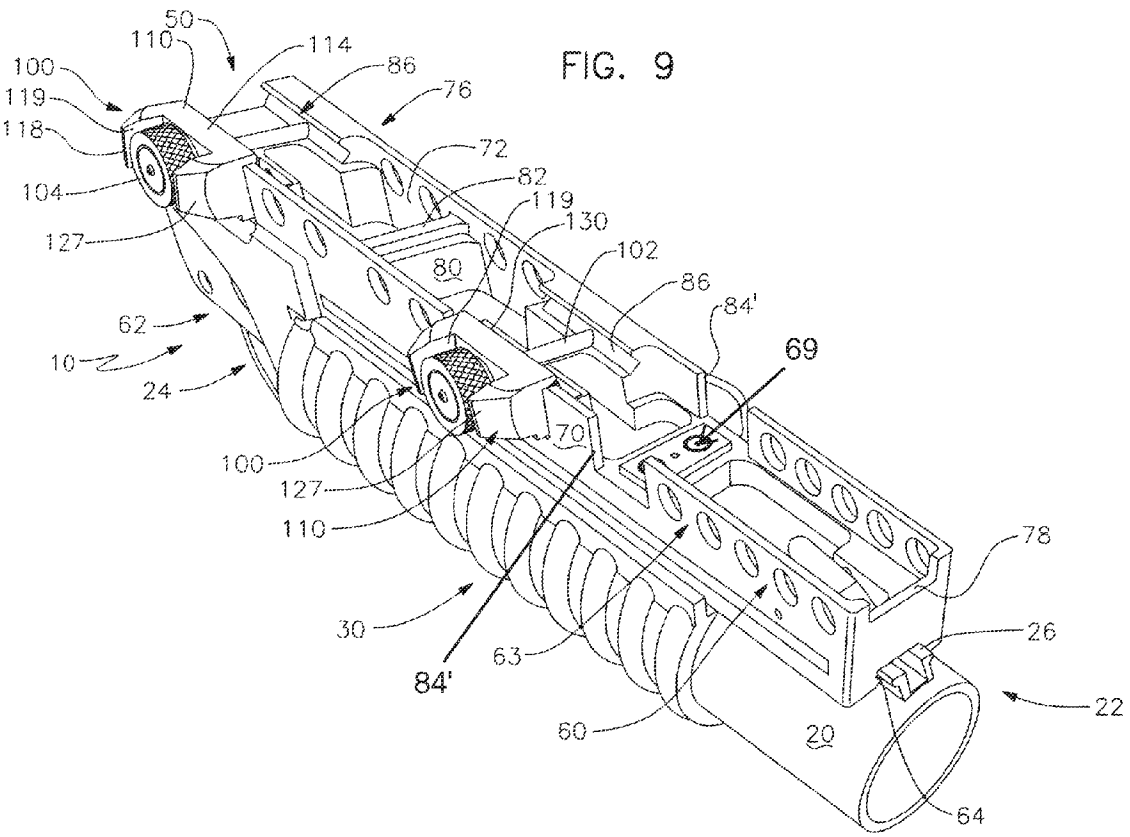
FIG. 9 depicts grenade launcher of FIG. 1 wherein an alternately configured clamp block of a clamp assembly variant is shown.
Figure 12:
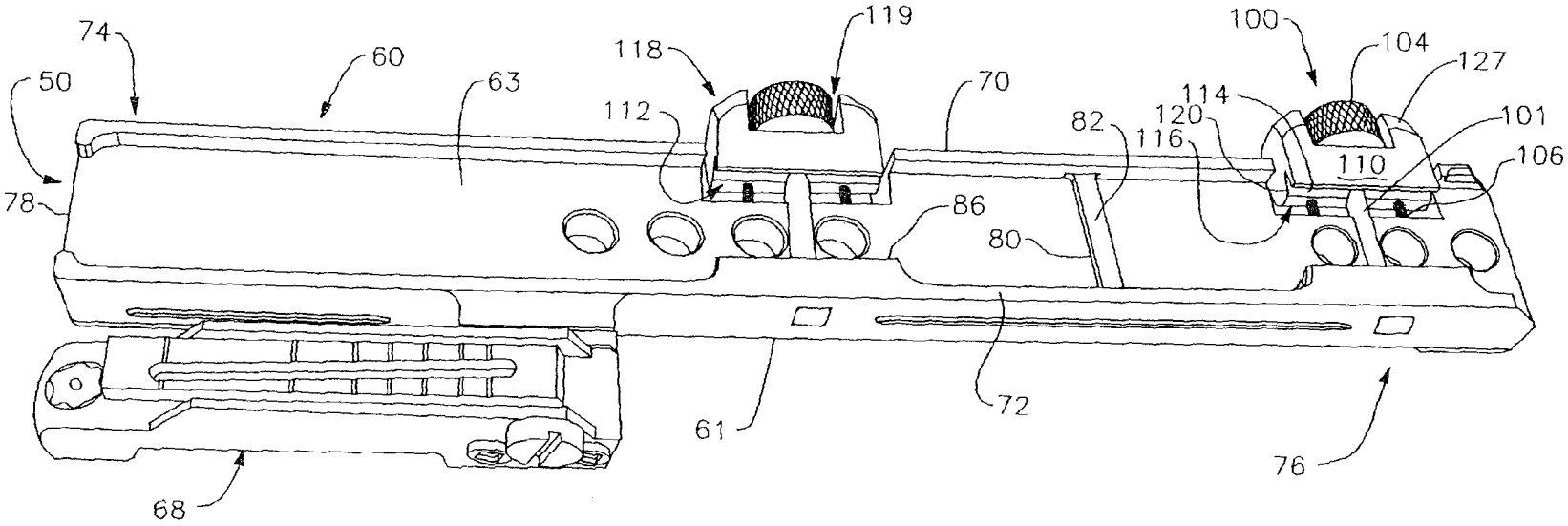
FIG. 12 depicts, slightly from above, an interbar characterized by a profiled rail attachment structure, more particularly, an adapted upper interbar portion and a clamp assembly operatively supported thereby.

With initial general reference to FIGS. 1 & 2, as well as FIG. 9, there is shown means for operatively uniting a supplemental device, e.g., an M203 grenade launcher 10, directly to a profiled rail of a rail structure. Likewise, means for operatively uniting a supplemental device indirectly to a profiled rail of a rail structure, as by an interbar or the like, is shown in FIG. 12, with particulars thereof depicted in FIGS. 13 & 14. Generally, a device or article 50 is provided for selective affixation to a profiled rail of a rail structure, the device, article, or fixture 50 generally comprising a body 60 (FIGS. 1 & 9), 60' (FIG. 12) having an upper portion 63, and a clamp assembly 100 (FIG. 1), 100' (FIGS. 9 & 12) operatively supported by upper portion 63 of the body 60, 60'.

As to the former representations (i.e., FIGS. 1, 2 & 9), the fixture body 60 is advantageously, but not necessarily part-and-parcel of a supplemental device, for example as shown, body 60 comprises a receiver of the M203 grenade launcher (i.e., the fixture body is integral to the supplemental device). As to the later representation (i.e., FIG. 12), and contrariwise, fixture body 60' advantageously comprises an interbar or the like, a lower body portion 61 thereof adapted to receive a supplemental device (see e.g., U.S. Pat. Nos. 6,453,594, 6,134,823 & 5,930,935 for representative or exemplary interbar attachment solutions) as opposed to comprising a supplemental device or portions thereof.

With continued specific reference to FIGS. 1, 2 & 9, the M203 grenade launcher 10 as shown, may be fairly characterized, by a launcher barrel 20 with a barrel handguard 30, and a barrel latch 40, and a launcher sight 68 (FIG. 1). Launcher barrel 20 is fairly characterized by opposing ends, namely, a muzzle end 22 and a munition loading/cartridge discharge end 24, and a receiver rail 26 which is operatively received by a portion of launcher receiver 60.

Launcher receiver/body 60 may be fairly characterized by a trigger assembly 62, a barrel rail track 64 for receipt of receiver rail 26, a forward barrel stop 66, and at least a single clamping assembly 100. Moreover, launcher receiver 60 generally includes opposing, spaced apart, upstanding longitudinal sidewalls 70, 72 which generally define or delimit a profiled rail receiving space, opposing end portions, namely, fore 74 and aft 76 portions, the fore end portion advantageously characterized by a notch or cut-out 78 as shown, and a transverse upstanding wall segment 80 extending between the sidewalls 70, 72 and fairly characterized by a rib 82. As depicted, advantageously but not necessarily, an upstanding longitudinal sidewall of the upstanding longitudinal sidewalls (i.e., at least one of the two, e.g., sidewall 72 as indicated) may include a discontinuity, e.g., a cut-out 84 or the like, to facilitate the hosting of a sight via the receiver as is readily appreciated with particular reference to FIG. 1, and also FIG. 9 wherein opposingly paired cut outs 84' are provided, along with sight mount or anchor 69, such that a left or right sight mounting is enabled for a hosted device.

In connection to the upstanding longitudinal sidewalls, sidewall segments thereof are noted. More particularly, one upstanding longitudinal sidewall of the upstanding longitudinal sidewalls, e.g., sidewall 72 as indicated, includes profiled segments, more particularly, and advantageously, spaced apart integral profiled segments 86, with the other upstanding longitudinal sidewall of the upstanding longitudinal sidewalls, e.g., sidewall 70 as indicated, including accommodations for adjustable sidewall segments, e.g., clamping blocks 110 of clamping assembly 100. As should be appreciated by reference to either of FIG. 1, 2, or 9, the aft end portion 76 includes a first integral segment of the spaced apart integral profiled segments, a first adjustable sidewall segment in opposition thereto, with a second integral segment of the spaced apart integral profiled segments generally intermediate the fore 74 and aft 76 end portions of receiver 60, a second adjustable sidewall segment in opposition thereto.

Figure 4:
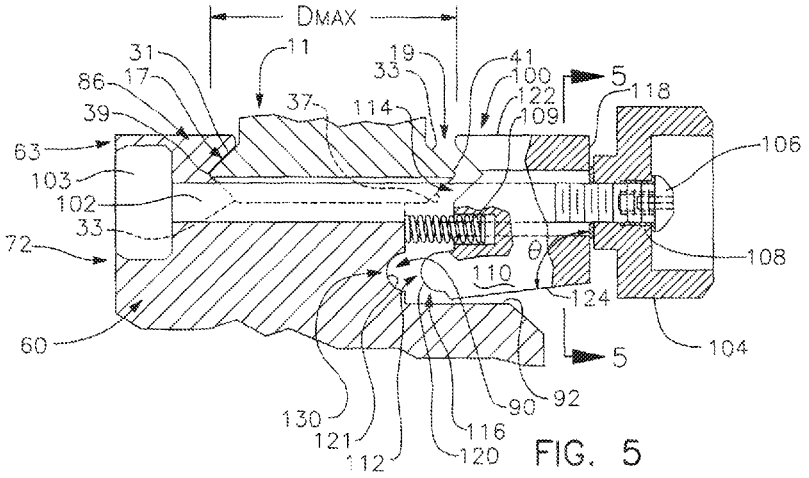
FIG. 4 depicts, in partial sectional view about line 4-4 of FIG. 2, an initial profiled rail receipt by the launcher receiver prior to securement of the grenade launcher to the profiled rail of the rail structure via advancement of a self-seating clamping block of the clamping assembly, the rail profile of the profiled rail being of a relative maximum dimension ($D_{max}$)

Prior to the provisions of particulars with regard to clamping assembly 100, several rail related observations in connection to FIGS. 2 & 4 are believed worthwhile. An illustrative, non-limiting mounting rail structure is depicted in FIG. 2, namely, mounting rail structure 9 from Knight's Armament Company (FL, USA). The mounting rail structure is characterized by plural mounting rails, each rail 11 including a plurality of transverse ribs 13 which are spaced apart by a plurality of recoil grooves 15. The transverse ribs 13 are each fairly characterized by first 17 and second 19 sides, opposing "top" sloping segments 31, 33, and opposing "bottom" sloping segments 35, 37, the sloping segments delimiting first and second side apexes 39, 41 for each rib 13 (FIG. 2 or 4). As should be appreciated with reference to FIG. 2, cut-out 78 of fore end portion 74 receives any rail portion which might be present forward of the receiver, i.e., to the extent that the rail length exceeds the receiver length, the cut-out permits a sufficient mating interface in furtherance of the union of the structures.

Figure 3:
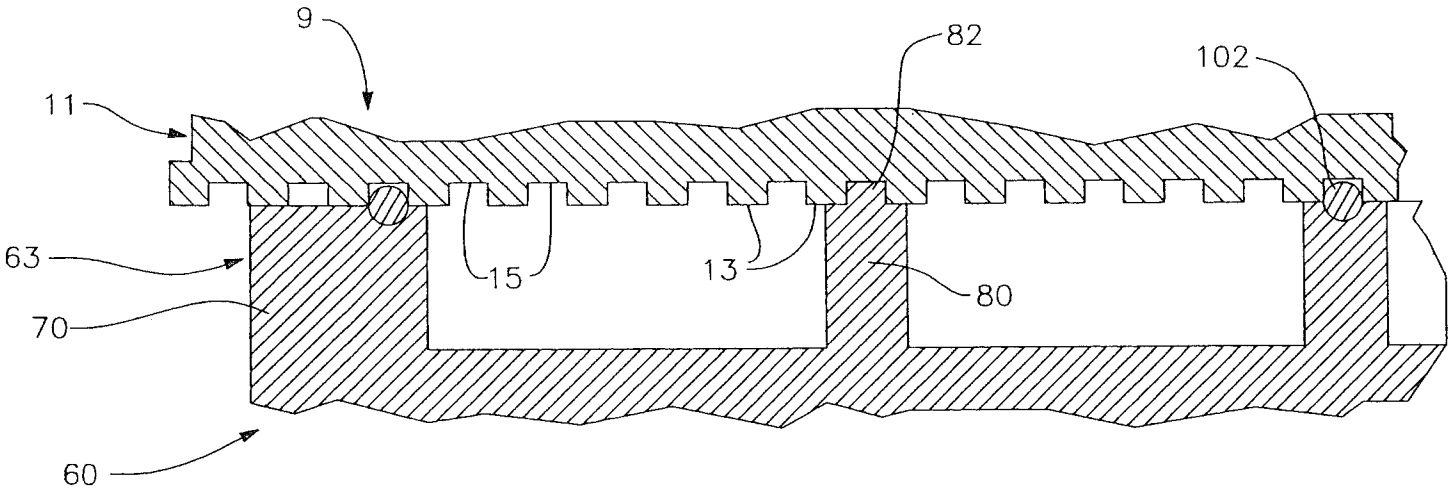
FIG. 3 depicts, in partial sectional view about line 3-3 of FIG. 2, a mated/mating relationship between/for a combination of the launcher receiver and the profiled rail of the rail structure.

In relation to the spaced apart integral profiled segments of the receiver, each generally include a surface adapted to matingly receive an apex of the ribs of the mounting rail, with the integral profiled segments advantageously, but not necessarily dimensioned to receive four ribs (see e.g., FIG. 3). Moreover, rib 82 of the transverse upstanding wall segment 80 extending between sidewalls 70, 72 matingly receives a recoil groove of the rail via an engagement of the receiver in relation to the rail as indicated in FIG. 2.

With continued reference to FIGS. 1, 2 & 9, and particular reference to FIGS. 4-8, a pair of clamping assemblies 100 are advantageously provided as shown. Each assembly generally includes clamping block 110, a shaft 102 upon which block 110 is carried (i.e., the block is advanceable thereupon), a thumb screw 104 or the like selectively advanceable upon a threaded free end portion of shaft 102 in furtherance of advancing or urging the clamping block 110 in a direction toward a companion integral profiled segment 84, and means for retaining the thumb screw 104 upon the shaft 102, e.g., a fastener 106 and sleeve 108 combination which permits reversible retention of the thumb screw 104 upon the threaded segment of the shaft 102. Moreover, resilient elements, e.g., springs 109 as shown, are advantageously interposed between the clamping block and a segment of the receiver, on each side of the shaft as indicated, so as to bias clamping block 110 away from the companion integral profiled segment 84 and/or toward and against the thumb screw 104 (i.e., in an opened or ready rail receipt condition). Commonplace anchoring of the shaft of the clamping assembly in relation to the receiver is as indicated, namely, an end portion of the shaft, opposite the threaded segment, terminates in or otherwise includes a head 103 which is retained in a recess of upstanding sidewall 72 of the receiver.

With particular reference now to FIGS. 4 & 6, and FIGS. 7 & 8, a profile of self-seating clamping block 110 is advantageously depicted. A face 112 of block 110 generally includes upper 114 and lower 116 portions, and is generally dimensioned, top to bottom, so as to exceed a corresponding dimension of its opposing face, i.e., a block back 118, 118'. The upper face portion 114 of the block 110 is fairly characterized by a rib apex receiving segment, this upper face portion segment is in general accord with the surface of the integral profiled segments of the receiver which are adapted to matingly receive the apex of the ribs of the mounting rail. Like its companion integral profiled segment, the face of the block is advantageously dimension to receive four ribs, two fore and two aft of the shaft of the clamping assembly 100 (see e.g., FIG. 3).

The lower face portion 116 of the block 110 is fairly characterized by a longitudinally extending rounded protuberance 120 which delimits a forward most extent of the block face 112. As indicated in the figures, a corresponding channel 121, for receipt of rounded protuberance 120, longitudinally extends across a mating segment 130 of receiver 60, the mating segment in a spaced apart condition with regard to the integral profiled segments 86 of the receiver 60.

Figure 5:
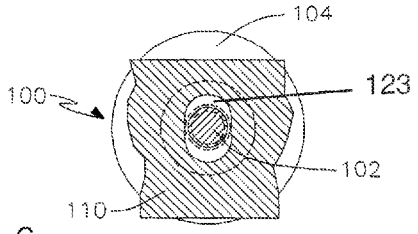
FIG. 5 depicts, in partial sectional view about line 5-5 of FIG. 4, the self-seating clamp block of the clamp assembly.

The clamping block 110 further includes upper 122 and lower 124 longitudinally extending surfaces, which laterally extend between block face 112 and block back 118, 118', colloquially, a block top and a block base, and a through hole 123 (FIG. 5). While the upper longitudinally extending surface 122 is generally configured to mimic the upper longitudinally extending surface of its companion integral profiled segment 86 (e.g., extending so as to be perpendicular to the block back; alternately, share a common angular relationship $\alpha$, $\alpha'$ between upper longitudinally extending surfaces and a profiled surface intersecting same for receipt of opposed upper sloping segments of the transverse ribs (see e.g., FIG. 6), the lower longitudinally extending block surface 124 is not intended to be "squared-up" with lower surface 92 of a profiled free edge segment 90 of the upper body portion 63 in furtherance of a self-seating engagement of the clamping block, more particularly the upper face 122 thereof with rib 13, via a rocking or pivotable engagement of the lower face 124 thereof with profiled free edge segment 90 of the upper body portion 63.

Figure 6:
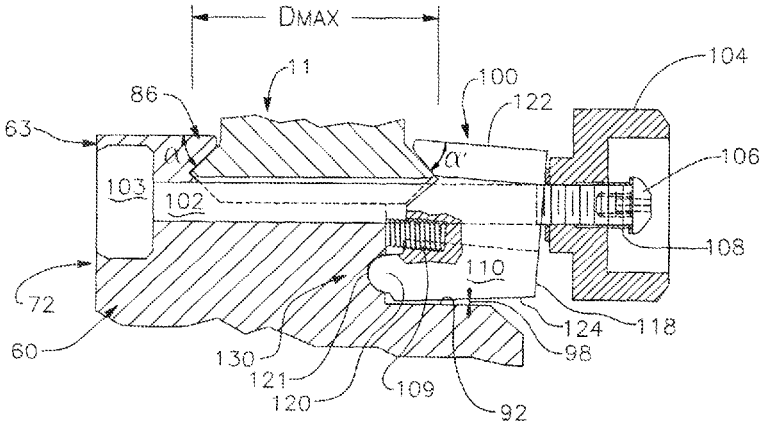
FIG. 6 depicts a clamped profiled rail receipt condition for the elements of FIG. 4.
Figure 7:
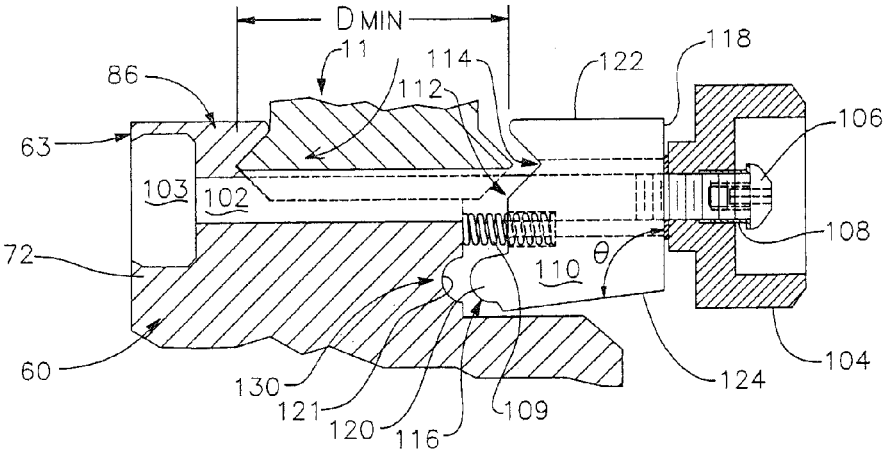
FIG. 7, in a view as FIG. 4, depicts an initial profiled rail receipt by the launcher receiver prior to securement of the grenade launcher to the profiled rail of the rail structure via advancement of the self-seating clamping block of the clamping assembly, the rail profile of the profiled rail being of a relative minimum dimension ($D_{MIN}$)
Figure 8:
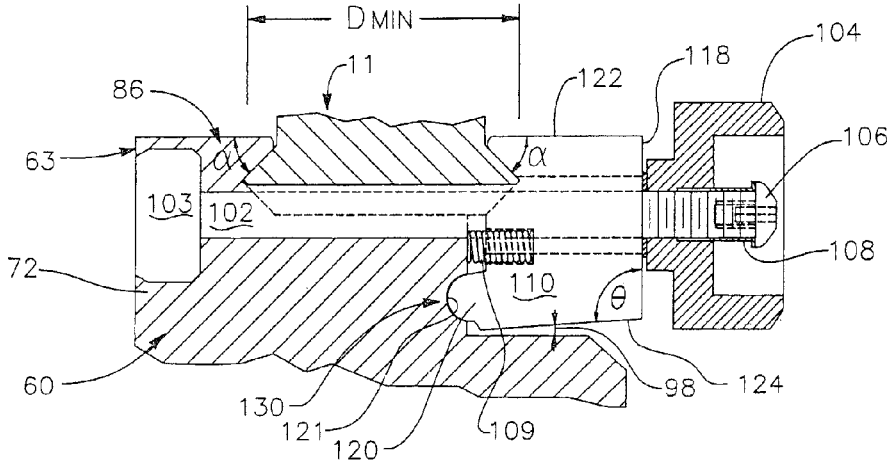
FIG. 8 depicts a clamped profiled rail receipt condition for the elements of FIG. 7.

Lower longitudinally extending block surface 124 generally extends from block back 118 at an angle $\theta$ greater than 90°, as shown, in furtherance facilitating sufficient urged engagement of the clamping block with a rail having a rib dimension and/or configuration within a select range of rib dimensions and/or configurations, namely, a range delimited by a maximum rib dimension $D_{MAX}$/configuration (e.g., FIGS. 4 & 6) and a minimum rib dimension $D_{MIN}$/configuration (e.g., FIGS. 7 & 8). Notionally, and alternately, the clamp block may be fairly characterized as having a base whose profile is non-linear, e.g., arcuate or otherwise curved, or as having a tapering or sloping linear base as shown, more particularly, as having a base which extends away and upward in relation to the portion of the clamping block (i.e., lower face portion 124 thereof) pivotingly received by a mating portion of profiled free edge segment 90 of the upper body portion 63. Such block base configuration yields a gap 98 (FIGS. 6 & 8) between the block base and lower surface 92 of profiled free edge segment 90 of upper body portion 63.

With continued reference to FIGS. 4 & 6 on one hand, and FIGS. 7 & 8 on the other hand, as well as FIG. 2, two particular functional aspects of and/or for body 60 are to be noted in relation to an operative engagement with a profiled rail of a rail structure. First, three fore/aft points of engagement are provided (FIG. 2), namely, those delimited or established by receipt of shafts 102, i.e., portions thereof, of clamp assemblies 100 by corresponding recoil grooves, and receipt of the rib 82 of the transverse wall segment 80 in a recoil groove intermediate the recoil grooves in receipt of the shaft portions. Second, via provision of clamping assembly 100 characterized by self-seating clamping block 110 capable of a rail responsive pivot/rotation via a rocking interface between and among the lower face portion 116 of block 110 and its opposing seat, i.e., the mobility of the block via a variable seating of the longitudinally extending rounded protuberance 120 within channel 121 longitudinally extending across mating segment 130 of receiver 60, an operative urged engagement of a rail between the upstanding longitudinal sidewalls is obtained for rails having a rib dimension and/or configuration within a select range of rib dimensions and/or configurations.

Referring now to FIGS. 10 & 11, an alternate clamp assembly, not entirely inconsistent with that described to this point, is generally shown. The depicted components include clamping block 110, a threaded clamp stud or drawdown axle with a square blind head 101, a gang of common spring washers 105, a thumb screw 104 or the like, a plug bushing 107, and a fastener 106. Resilient elements, e.g., springs 109 are likewise provided to provided an outward bias for the clamping block relative to the profiled free edge segment of the upper body portion of the device. While the clamping face of the clamping block is as previously described, and not inconsistent with the representations thereof in connection to FIGS. 4 & 6 or FIGS. 7 & 8, block back 118' is alternately configured.

More particularly, rather than arranging/configuring elements of the assembly to result in the thumbscrew to stand out or be proud of the block back, the block back advantageously but not necessarily includes a cut out 119 or the like within which the thumbscrew resides. Via the subject configuration, fore and aft profiled members 127 are delimited with the thumbscrew occupying a space intermediate the profiled members as shown.

Figure 13:
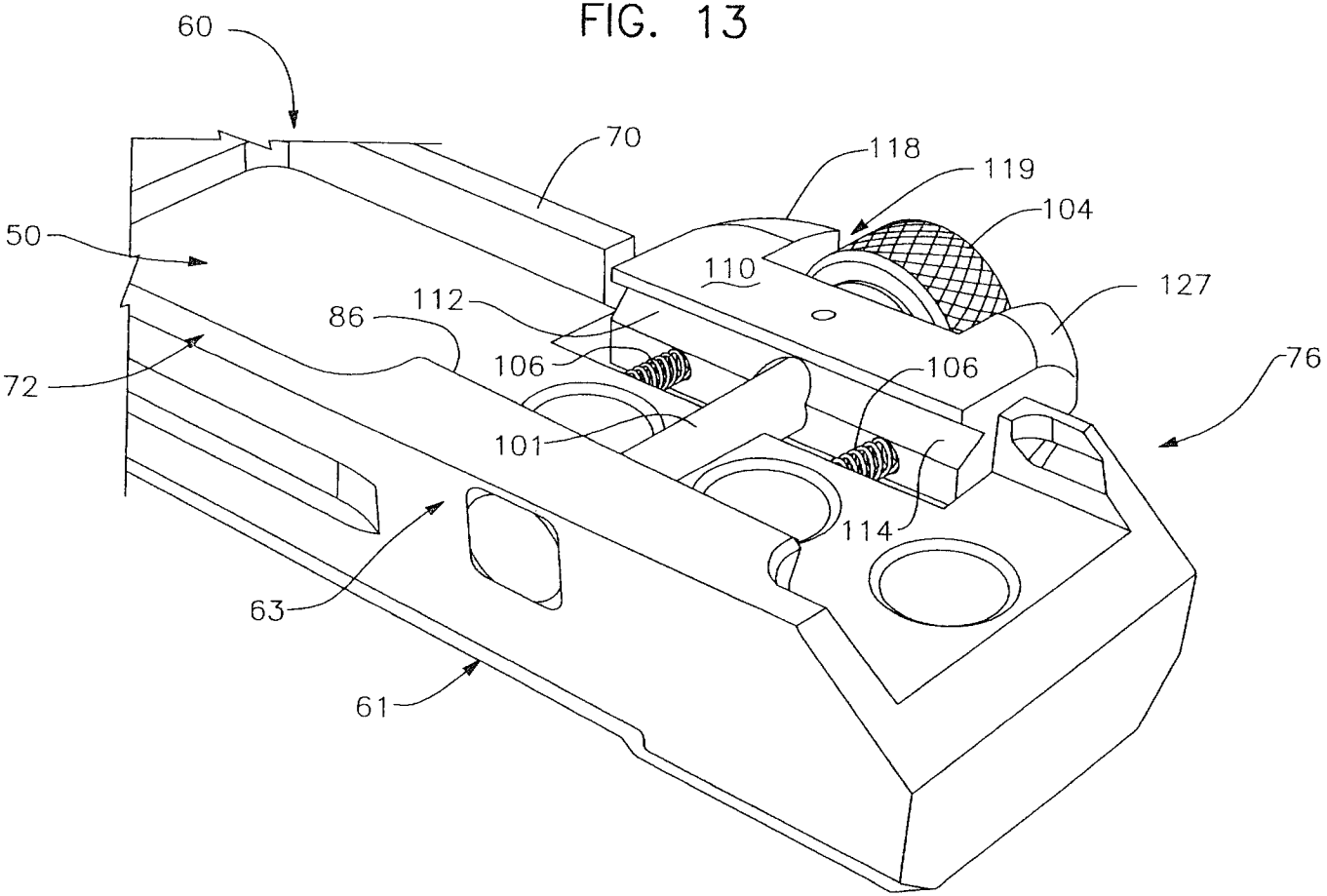
FIG. 13 is a partial (aft) end view, slightly from above, of the FIG. 12 structure; and, FIG. 14 is an alternate view of the partial (aft) end of the FIG. 12 structure, namely, a view opposite that of FIG. 13.
Figure 14:
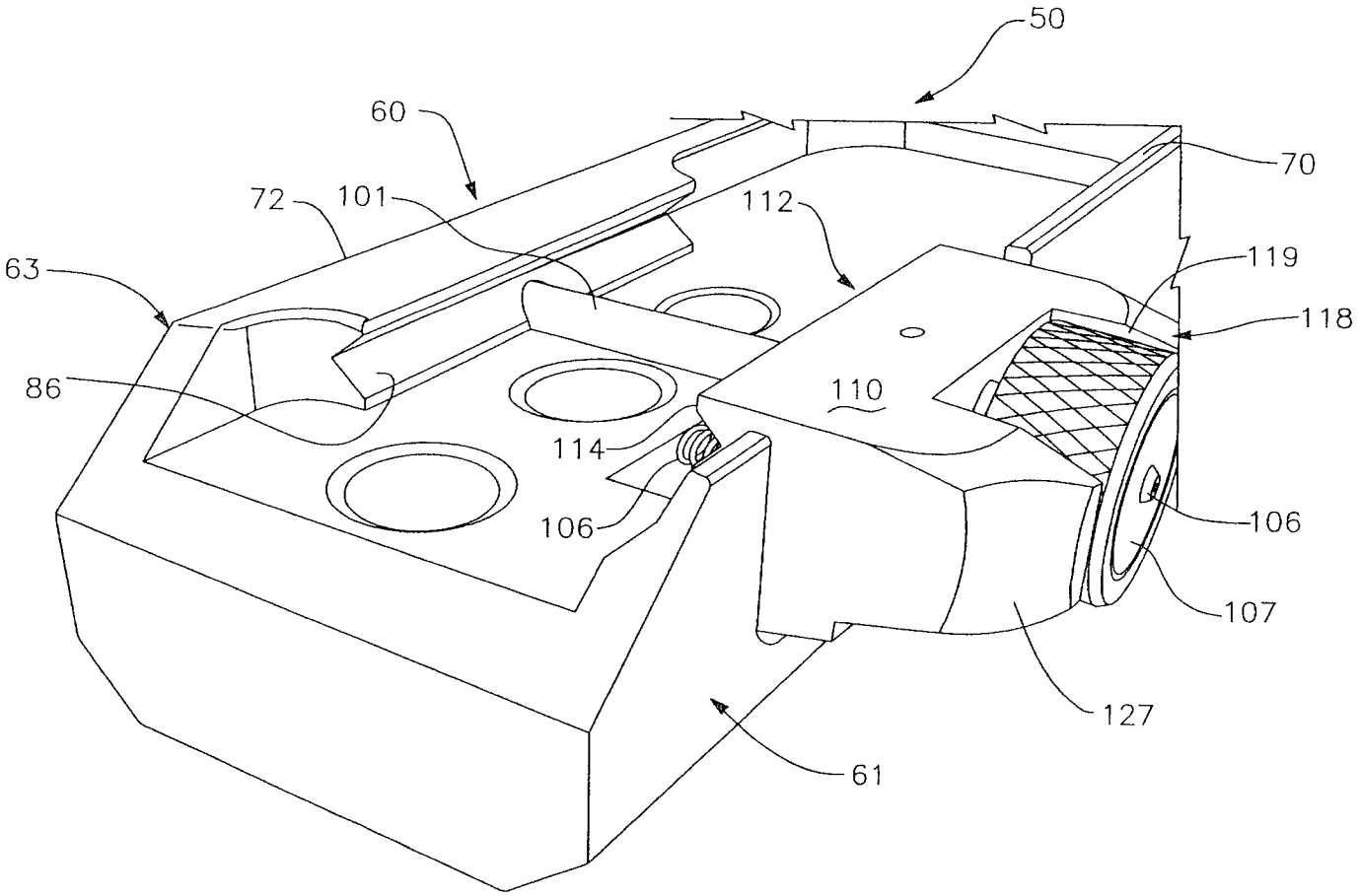

With reference now to FIG. 12, and the particulars thereof depicted in FIGS. 13 & 14, there is shown an alternate environment or context for the subject profiled rail attachment solution. In lieu of a direct supplemental device/profiled rail integration, an indirect integration is contemplated. It is believed advantageous to offer modular or stand alone grenade launcher owner/operators, and/or owner operators of grenade launchers not especially equipped for profiled rail support, a device or fixture which can readily receive a launcher or the like while nonetheless in turn being able to be received upon a profiled rail of a rail structure. Commonly, and as is well know, a grenadier may readily equip his/her launcher with an interbar or the like in furtherance of supplying a supplemental device functionality to a host/primary weapon. It is in keeping with that approach that the device of FIG. 12 is provided.

As with descriptions to this point, a device body 60' having an upper portion 63 opposite lower portion 61 and a clamp assembly 100' operatively supported by upper portion 63 is generally depicted. Upper portion 63 of the device body 63 generally includes opposing, spaced apart, upstanding longitudinal sidewalls 70, 72 which generally define or delimit a profiled rail receiving space, opposing end portions, namely, fore 74 and aft 76 portions, the fore end portion advantageously characterized by a notch or cut-out 78 as shown, and a transverse upstanding wall segment 80 extending between the sidewalls 70, 72 and fairly characterized by a rib 82. As depicted, body 60' is equipped with a sight 68 to aid launcher sighting.

In connection to the upstanding longitudinal sidewalls, sidewall segments thereof are noted. More particularly, one upstanding longitudinal sidewall of the upstanding longitudinal sidewalls, e.g., sidewall 72 as indicated, includes profiled segments, more particularly, and advantageously, spaced apart integral profiled segments 86, with the other upstanding longitudinal sidewall of the upstanding longitudinal sidewalls, e.g., sidewall 70 as indicated, including accommodations for adjustable sidewall segments, e.g., self-seating clamping blocks 110 of clamping assembly 100'. Particulars of clamp assembly 100' have been presented in relation to FIGS. 10 & 11, and, as previously noted, are not inconsistent with either the prior description of same, or depictions in relation to FIGS. 3-8. Moreover, relationship for, between and among device body 60' and clamp assembly 100' are readily appreciated with reference to the detailed partial views of the aft end/end portion of the FIG. 12 device in each of FIGS. 13 & 14.

Finally, since the assemblies, subassemblies, devices, structures and/or elements disclosed directly or implicitly herein may be embodied in other specific forms without departing from the spirit or general characteristics thereof, some of which forms have been indicated, the features described and depicted herein/herewith are to be considered in all respects illustrative and not restrictive. Accordingly, the scope of the subject invention is as defined in the language of the appended claims, and includes not insubstantial equivalents thereto.

That which is claimed:

1. A device for selective affixation to a profiled rail, the device comprising:

a. a body having an upper portion within which a portion of a first rib side of a profiled rail of a rail structure is receivable; and, b. a clamp assembly operatively supported by said upper portion of said body, said clamp assembly characterized by a linearly advanceable self-seating clamping block having a face comprised of upper and lower face portions, said upper face portion characterized by a profiled rail receiving segment, said lower face portion characterized by a longitudinally extending rounded protuberance, said longitudinally extending rounded protuberance delimiting a forward most structure of said face of said linearly advanceable self-seating clamping block, said linearly advanceable self-seating block linearly advanceable toward said body such that said face thereof engages a portion of said body and a second rib side of the profiled rail received by said body.

2. The device of claim 1 wherein said clamping block is biasingly spaced apart from said body.

3. The device of claim 1 wherein said clamping block is biasingly spaced apart from said upper portion of said body.

4. The device of claim 1 wherein said clamping block includes a base having a non-linear profile.

5. The device of claim 1 wherein said clamping block includes a sloping base.

6. The device of claim 1 wherein said clamping block is delimited by a base extending away and upward relative to said face of said clamping block.

7. The device of claim 1 wherein said body comprises a receiver of a weapon or weapon facsimile, or a portion of said receiver.

8. The device of claim 1 wherein said body comprises a receiver of a grenade launcher or grenade launcher facsimile, or a portion thereof.

9. The device of claim 1 wherein said body comprises an accessory article or portion thereof.

10. The device of claim 1 wherein said body comprises a platform for select receipt of an accessory article, said platform having a lower portion adapted to receive an accessory article or portion thereof.

11. The device of claim 1 wherein said body includes a lower portion adapted to receive a profiled rail or a portion thereof.

12. The device of claim 1 wherein said upper portion of said body is further characterized by a transverse rib receivable within a recoil groove of the profiled rail of a rail structure characterized by a plurality of spaced apart recoil grooves.

13. The device of claim 1 wherein said body further includes a first sidewall segment and a second sidewall segment, said first sidewall segment having a profiled rail receiving surface, said second sidewall segment having a channeled face.

14. The device of claim 1 wherein said clamp assembly further comprises a shaft upon which said clamping block is linearly advanceable, said shaft supported by said body.

15. The device of claim 1 wherein said clamp assembly further comprises a shaft upon which said clamping block is linearly advanceable, said shaft supported by said body and receivable within a recoil groove of the profiled rail of a rail structure characterized by a plurality of spaced apart recoil grooves.

16. The device of claim 1 comprising a further clamping assembly, said upper portion of said body further characterized by third and fourth sidewall segments, as said first and said second sidewall segments respectively, the device thereby characterized by a dual clamped interface for the profiled rail delimited by said first and second sidewall segments and said third and fourth sidewall segments.

17. The device of claim 1 in operative combination with a supplemental device or an accessory article.

18. The device of claim 1 in operative combination with weapon or weapon facsimile.

19. The device of claim 1 in operative combination with a host weapon or weapon facsimile characterized and/or in operative combination with a supplemental weapon or supplemental weapon facsimile.

* * * * *